US006182730B1

(12) United States Patent
Muir

(10) Patent No.: US 6,182,730 B1
(45) Date of Patent: Feb. 6, 2001

(54) LABEL CUTTING APPARATUS

(75) Inventor: David F. Muir, Grand Rapids, MI (US)

(73) Assignee: Grand Rapids Label Company, Grand Rapids, MI (US)

( * ) Notice: Under 35 U.S.C. 154(b), the term of this patent shall be extended for 0 days.

(21) Appl. No.: 09/057,318

(22) Filed: Apr. 9, 1998

Related U.S. Application Data

(60) Provisional application No. 60/043,295, filed on Apr. 11, 1997.

(51) Int. Cl.[7] ..... B65C 9/18; B65C 9/26; B65C 9/28

(52) U.S. Cl. ..... 156/387; 156/517; 156/556; 156/566; 156/DIG. 33; 156/DIG. 37; 156/DIG. 38; 156/521

(58) Field of Search ..... 156/556, 521, 156/566, 540, 277, 387, DIG. 31, DIG. 33, 384

(56) References Cited

U.S. PATENT DOCUMENTS

| | | | | |
|---|---|---|---|---|
| 3,985,605 | * | 10/1976 | Treiber et al. | 156/384 |
| 4,108,706 | | 8/1978 | Brands et al. . | |
| 4,662,835 | * | 5/1987 | Fukuda et al. | 425/145 |
| 4,676,859 | * | 6/1987 | Cleary, Jr. et al. | 156/361 |
| 5,040,461 | * | 8/1991 | Van-Ocker | 101/288 |
| 5,055,154 | | 10/1991 | Zodrow et al. . | |
| 5,206,996 | * | 5/1993 | McDaniel | 30/101 |
| 5,431,763 | | 7/1995 | Bradshaw . | |
| 5,441,352 | * | 8/1995 | Shiota | 400/621 |
| 5,531,853 | | 7/1996 | Cubow et al. . | |
| 5,804,023 | * | 9/1998 | Carpenter et al. | 156/261 |

* cited by examiner

*Primary Examiner*—Richard Crispino
*Assistant Examiner*—Sue A. Purvis
(74) *Attorney, Agent, or Firm*—Rader, Fishman, Grauer & McGarry an office of Rader, Fishman & Grauer PLLC

(57) ABSTRACT

A label application apparatus comprising a main housing and a printer and an applicator mounted to the main housing for applying a label to an object. A supply reel is rotatably mounted to the main housing and has a continuous web of label material thereon. A feed mechanism is also provided for feeding the continuous web of label material from the supply reel to the printer and applicator. A cutting mechanism is associated with the applicator to cut labels from the continuous web of label material between the printer and the applicator whereby the applicator then places the severed label onto the object.

42 Claims, 7 Drawing Sheets

LABEL CUTTING APPARATUS

CROSS REFERENCE TO RELATED APPLICATIONS

This invention claims priority of U.S. patent application Ser. No. 60/043,295, filed Apr. 11, 1997.

BACKGROUND OF THE INVENTION

1. Field of the Invention

The invention relates to a label printing and label cutting apparatus, and, particularly, to such an apparatus having an applicator for applying a printed and cut label to an object.

2. Description of the Related Art

In labeling objects such as packages, envelopes and the like, an apparatus is typically provided with a supply roll of label material on a continuous backing web or the like. Alternatively, the label material can be "linerless", i.e., without backing material. Typically, the label material on the backing is advanced from the supply reel past a printer which can provide desired indicia, such as text and graphics, onto the label, in addition to any indicia already pre-printed onto the label. The backing material is then advanced over a label separator roller or "peeler" bar onto a take-up reel while the label material, separated from the backing material, is advanced to a cutter and label applicator. By means of the cutter, the printed portion is cut from the continuous web of label material and is transferred to an object, such as package or envelope or the like, by the applicator.

The label cutter can comprise a lower fixed cutting blade and an upper guillotine-type blade which is mounted for oscillating movement with respect to the fixed cutting blade. Examples of prior art cutters of this type are shown in U.S. Pat. No. 5,531,853 and commonly-assigned U.S. patent application Ser. No. 08/717,497, filed Sep. 20, 1996 now U.S. Pat. No. 5,804,023.

In order to ensure that the label affixes to the object onto which it is applied, an adhesive is often applied to a rear side of the label and allowed to set after the label is applied to the object. For convenience, the adhesive is often applied to the continuous label material prior to severing a discrete label portion from the continuous web. These types of guillotine-type cutting mechanisms often accumulate the adhesive on the cutting edges or blades as the label portion is severed from the continuous web. As the adhesives accumulate and set on the knife edges of the upper and lower blades, the movable blade can shift laterally with respect to the fixed blade causing labels to be improperly cut.

SUMMARY OF THE INVENTION

The invention relates to a label application apparatus comprising a main housing, a printer mounted to the housing, an applicator mounted to the main housing adjacent to the printer for applying a label to an object, a supply reel rotatably mounted to the main housing and having a continuous web of label material thereon, a feed mechanism for feeding the continuous web of label material from the supply reel to the printer and applicator, and a cutting mechanism associated with the applicator to cut labels from the continuous web of label material between the printer and the applicator.

In one embodiment, the applicator is mounted to the main housing on hinges for movement between a first position aligned with the printer and a second position pivoted away from the first position for servicing and a fastener for selectively retaining the applicator in the first position.

In another embodiment, the printer is pivotally mounted to the housing for movement between a first position aligned with the applicator and a second position pivoted away from the first position for servicing, and a fastener for selectively retaining the printer in the first position.

In an additional embodiment, the applicator comprises an applicator housing and an applicator head, and the cutting mechanism comprises a first blade mounted to the applicator head for movement with the applicator head between a retracted and a cutting position and for relative movement between a cutting position and an extended position, the cutting position being intermediate the retracted and extended positions.

In a further embodiment, the printer comprises a printer bracket, a first arm pivotally mounted to the printer bracket and supporting a print head which is in registry with the label bracket, and a first spring biasing the first arm toward a roller mounted to the main housing.

A second blade can be fixedly mounted closely adjacent to the first blade and at least one spring can be mounted to the first blade and to one of the applicator and the main housing for biasing the first blade toward the second blade. The first blade is preferably slidably mounted to the applicator head for movement between the first and second positions. The at least one spring can further bias the first blade toward the cutting position. A stop can preferably be located between the first blade and the applicator head to limit the movement of the first blade with respect to the applicator head at the second position. A second stop is preferably located between the first blade and one of the main housing and the applicator housing to limit the movement of the first blade with respect to the applicator head between movement of the applicator head between the cutting and extended positions. A take-up reel can be rotatably mounted to the housing for accumulation of at least a portion of the continuous web of label material and a drive roller can be provided for driving the at least a portion of the continuous web of label material toward the take-up reel. A second arm can be pivotally mounted to the printer bracket with an idler roller rotatably mounted to an outer end thereof wherein the idler roller is in register with the drive roller. A second spring can be mounted between the second arm and the printer bracket to bias the idler roller against the drive roller.

In another embodiment, an applicator support is provided on the main housing and is adapted to support the applicator, a main housing connector is provided on the applicator and is adapted to be received by the applicator support. Thus, the applicator support is selectively supported by the main housing connector and its movement is thereby restricted to a downwardly direction but not in another direction with respect to the main housing. The applicator is selectively removably mounted to the main housing for applying a label to an article when mounted to the main housing and is selectively removable from the main housing by moving the applicator in the other direction for replacement or servicing.

The applicator support and main housing connector preferably comprise quick-release hinges to pivotally mount the applicator to the main housing. The other direction can be upwardly with respect to the main housing. A fastener can be removably mounted between the applicator and the main housing for restricting pivotal movement of the applicator with respect to the main housing.

In yet another embodiment, the main housing or the printer has a socket and the other has a fastener wherein the fastener and socket are constructed to selectively mount the printer to the main housing. The mounting of the fastener within the socket can also pivotally mount the printer to the main housing.

In an additional embodiment, the printer can further comprise an adjustment plate movably mounted to a printer bracket and further mounting the printing head. At least one spring can bias the adjustment plate with respect to the printer bracket whereby the selective movement of the adjustment plate with respect to the printer bracket varies the force of the print head against the print roller.

The adjustment plate can have opposing lateral edges and the at least one spring can comprise a spring disposed between each lateral edge of the adjustment plate and the print head. The adjustment plate can also have at least one elongated slot and at least one fastener wherein the at least one fastener is selectively mounted to the printer bracket within the at least one elongated slot to selectively mount the adjustment plate at a particular longitudinal position with respect to the printer bracket.

BRIEF DESCRIPTION OF THE DRAWINGS

The invention will now be described with reference to the drawings in which.

DETAILED DESCRIPTION OF THE PREFERRED EMBODIMENTS

Figure 1:
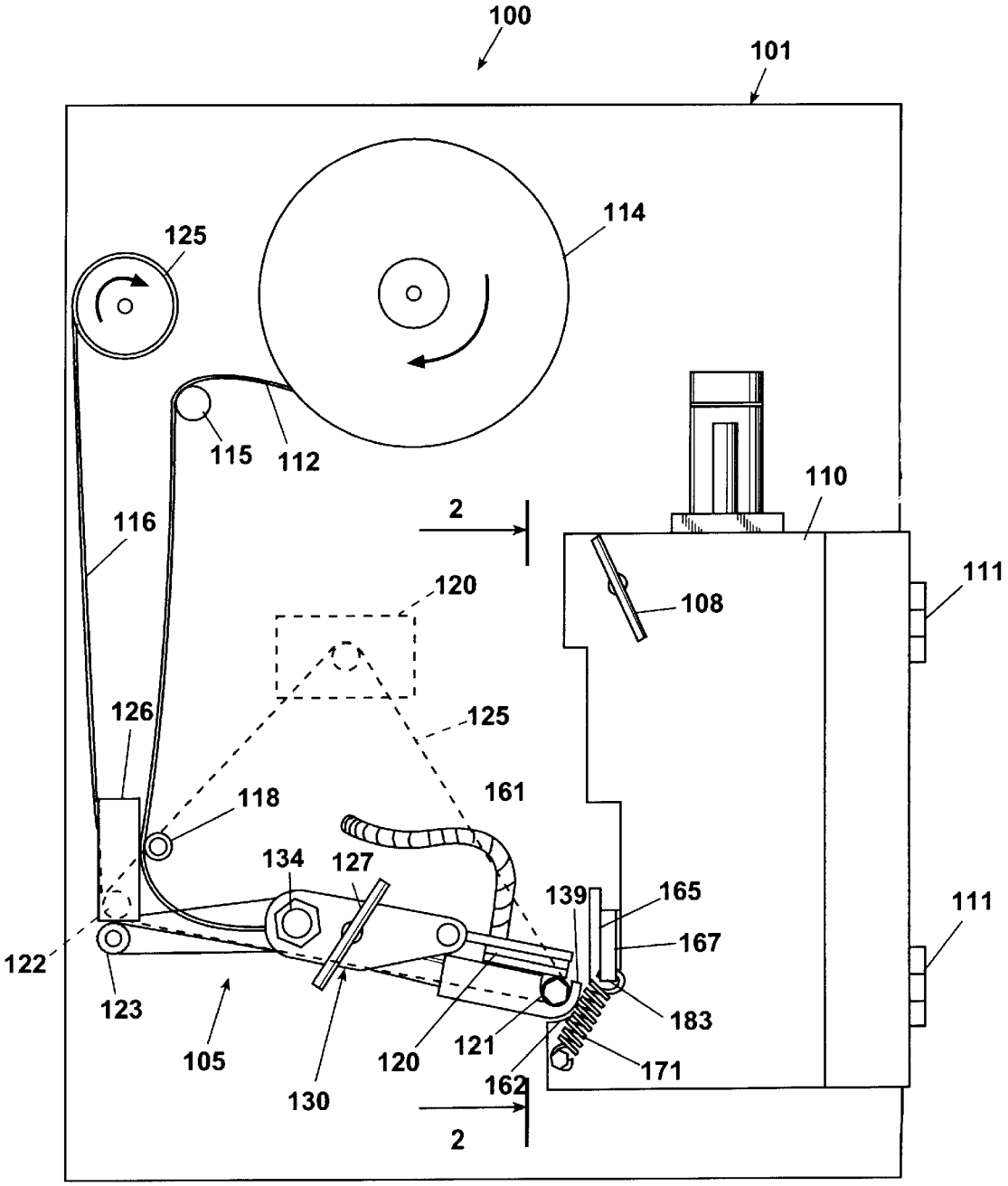
FIG. 1 is a frontal view of label printer/applicator apparatus incorporating the principles of the invention.

Referring now to the drawings and to FIGS. 1–4 in particular, a label printing and applying apparatus 100 is shown comprising a housing 101 which mounts a printing apparatus 105 and an applicator 110.

Figure 5:
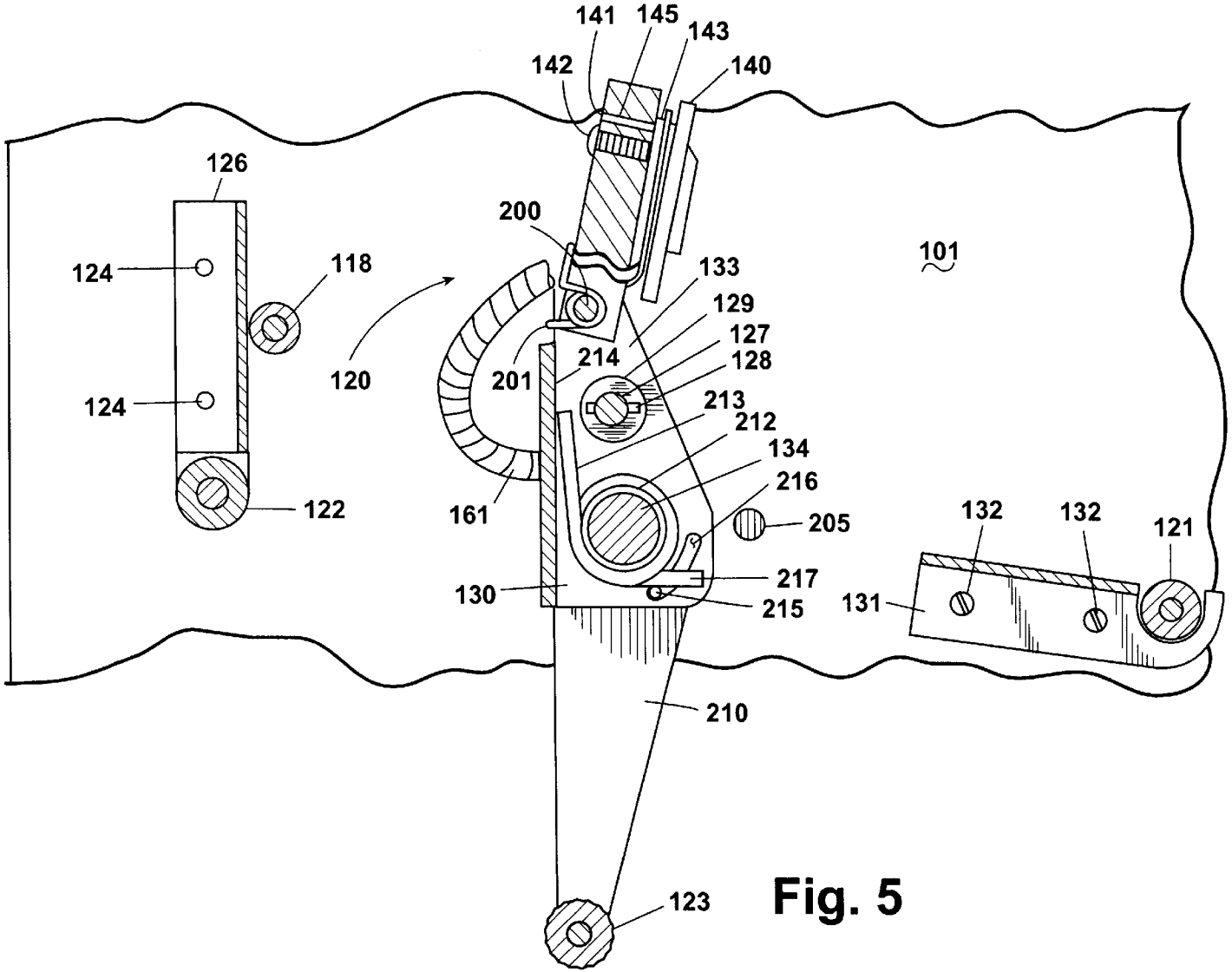
FIG. 5 is a cross-sectional view along line 5—5 of FIG. 3.

As shown in FIGS. 1 and 5, the housing 101 rotatably mounts a supply reel 114. The supply reel 114 carries a wound length of a continuous web of label material 112 applied to a backing material 116. An idler roller 115 can be provided laterally adjacent to the supply reel 114 and is used primarily for guiding a tensioned length of the continuous web of label material 112 and the backing material 116 toward the printer 105. A first idler roller 118 is rotatably mounted to the housing 101 to further guide the continuous web of label material 112 toward the printer 105. A primary drive roller 121 is rotatably mounted to the housing 101 and driven by a conventional stepper motor through an endless belt 125. A secondary drive roller 122 is also rotatably mounted to the housing 101 and driven by the motor 120 also through the belt 125. The secondary drive roller 122 is preferably mounted to the housing 101 by a mounting bracket 126 mounted to the housing 101 in a conventional fashion, such as by fasteners 124. The gear ratio of the secondary drive roller 122 can be varied with respect to the primary drive roller 121 so that any slack in the backing material 116 between the primary and secondary drive rollers 121 and 122 is minimized. Of course, if a linerless label material 112 is employed, the secondary drive roller 122 is not necessary.

The primary drive roller 121 is located adjacent the applicator 110. The primary drive roller 121 is located within a recess of a bracket 131 fastened to the housing 101 by fasteners 132. The bracket 131 includes an upper surface which has a leading edge located adjacent an outer circumference of the primary drive roller 121 referred to as a "peeler tip" 139 for facilitating removal of the label material 112 from the backing material 116 if a backing material 116 is used.

The apparatus 100 operates generally by providing the supply reel 114 with a length of label material 112. The label material 112 is fed over the idler roller 115 and the idler roller 118 and into the printer 105 where the label material 112 is printed with any desired text and graphics. After the label is printed, the label material 112 is fed to the applicator 110 where a discrete length of the label material 112 is severed from the continuous web and applied to an object. If a label material 112 having the backing material 116 is used, the remaining backing material 116 is fed between the secondary drive roller 122 and idler roller 123, and is accumulated on the take-up reel 125.

Figure 3:
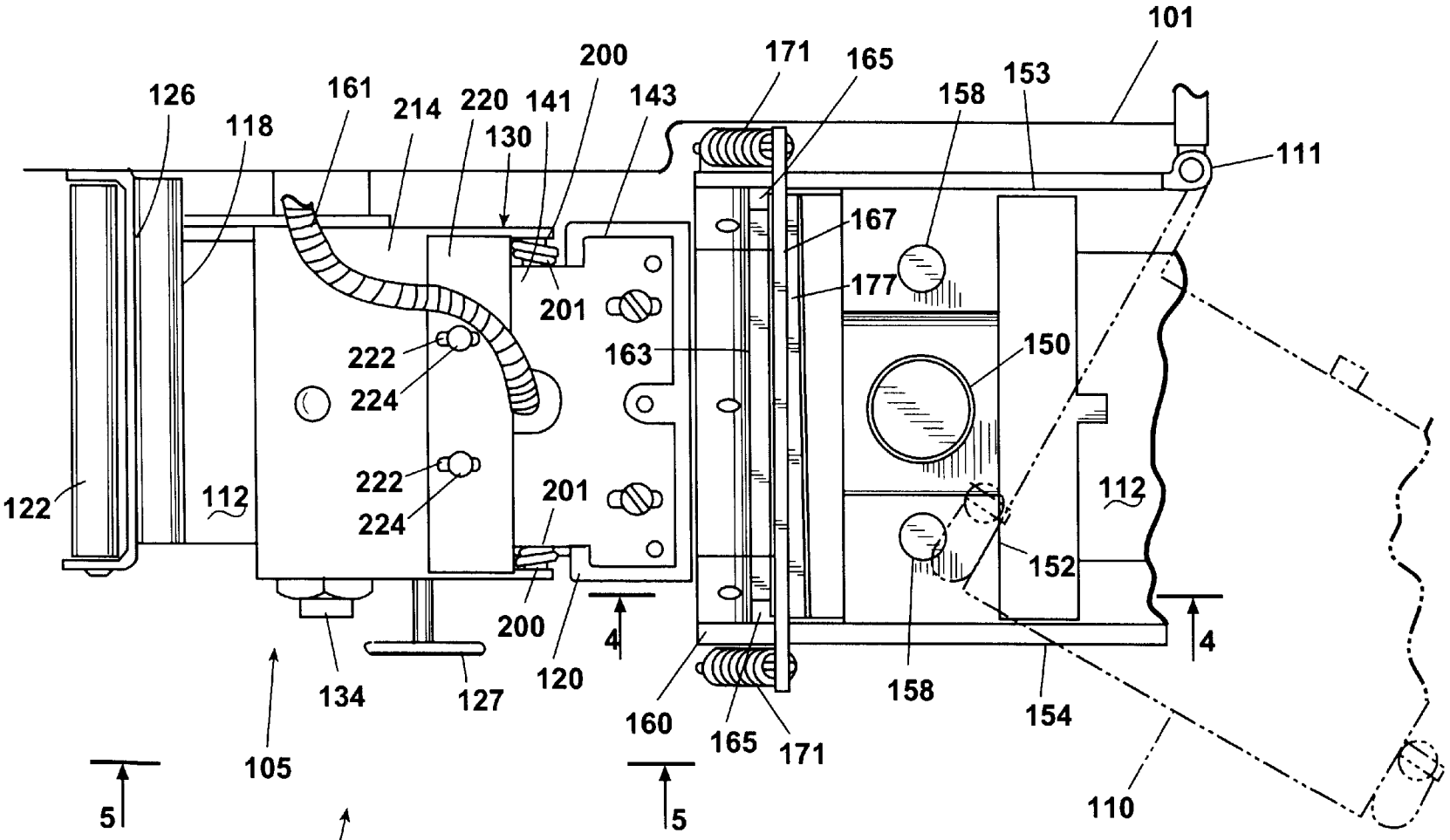
FIG. 3 is a top view of the printer/applicator apparatus of FIG. 1.
Figure 6:
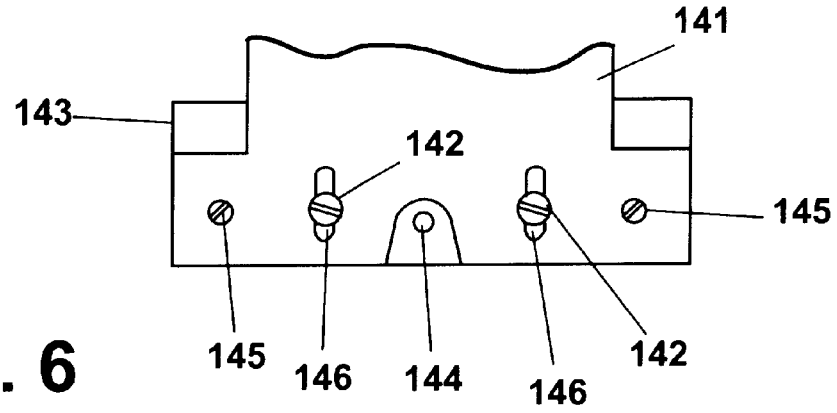
FIG. 6 is an enlarged partial top view of the print head of FIG. 5.

The printer 105 is shown in FIG. 1 and in greater detail in FIGS. 3, 5, and 6. The printer 105 comprises a printer bracket 130 defined by a pair of depending walls 133 which have a laterally-extending upper plate 214 extending therebetween. The depending walls 133 and, in turn, the printer 105, are pivotally mounted to a shaft 134 which extends from the housing 101. The printer 105 is preferably pivotally movable about the shaft 134 between a first position shown in FIG. 1 and a second, disengaged position shown in FIG. 5. The printer 105 is preferably retained in the first position shown in FIG. 1 by a releasable mechanism, such as a movable pin 127 which engages within an aperture 205 in the housing 101. The pin 127 preferably has one end provided with a cross pin 128 which extends laterally from either side of the pin 127. Further, the wall 133 adjacent the housing 101 is preferably provided with a sloped flange 129 which is engaged by the cross pin 128 as the pin 127 is urged within the aperture 205. The abutment of the cross pin 128 of the pin 127 against the sloped flange 129 creates a cam and cam follower relationship which facilitates removal of the pin 127 from the aperture 205. Thus, the printer 105 can be moved from the first position as shown in FIG. 1 by rotating the pin 127 and moving the cross pin 128 out of engagement with the sloped flange 129 of the aperture 205 and moving the printer 105 to the second position as shown in FIG. 5. Preferably, a spring (not shown) biases the pin 127 into the aperture 205 and the sloped flange 129 allows the pin 127 to be removed against the bias of the spring by rotating the pin 127.

An arcuate slot 216 is located in the depending wall 133 spaced from and preferably coaxial with, the shaft 134 extending through the walls 133. A rearwardly-extending arm 210, with an idler roller 123 rotatably mounted thereto, is pivotally mounted to the printer 105 around the shaft 134. The arm 210 is provided with an inwardly-extending pin 215 which is adapted to travel within the arcuate slot 216 in the depending wall 133 of the printer 105. A conventional arm spring 210 is mounted around the shaft 134 and has a pair of resilient arms 213 and 217 extending therefrom which abut an inner surface of the laterally-extending plate 214 and the pin 215 on the arm 210 located within the slot 216, respectively. The spring 212 thereby provides a clockwise bias (in the orientation shown in the drawings) so that the idler roller 123 is biased against the secondary drive roller 122 when the printer 105 is located in the first position shown in FIG. 1. The engagement of the idler roller 123 mounted to the printer 105 against the secondary drive roller 122 mounted to the housing 101 provides a positive traction for the backing material 116 following separation from the label material 112 and thereby positively drives the backing material 116 away from the printer 105 toward the take-up reel 125.

Preferably, the shaft 134 comprises a threaded member, such as a conventional shoulder bolt, which threads into a socket (not shown) in the housing 101 so that the shaft 139 can be removed therefrom. This permits an operator, upon failure of any component of the printer 105 to remove the entire printer 105 by disengaging the pin 127 from aperture 205 and removing the shaft 134. This reduces the "down time" for the apparatus 100 because a substitute printer 105 can be mounted in place of the failed printer 105 by this simple operation and the apparatus 100 can be restarted.

As shown in FIGS. 1, 5, and 6, a forward portion of each of the depending walls 133 of the printer 105 is provided with a laterally-extending shaft 200 therebetween which pivotally mounts a forwardly-extending plate 141. A lower portion of the plate 141 is provided with a support plate 143 with a conventional print head 140 mounted thereto by a conventional fastener 144 which passes through a cut-away portion of the plate 141. Elongated slots 146 allow for longitudinal positioning of the support plate 143 with respect to the plate 141 by movement of screws 142 within the elongated openings 146, thus connecting support plate 143 to the plate 141. A pair of laterally-spaced set screws 145 or the like mount within threaded openings in the plate 141 and engage against the support plate 143 to allow for angular adjustments about a longitudinal axis of the print head 140 with respect to the plate 141 for appropriate adjustment of the print head 140 to provide optimum printing results. A conventional data connection 161 between the print head 140 and a suitable data source (not shown) generates a signal corresponding to the indicia to be printed by the print head 140. By removing the fastener 144 and data connection 161, the print head 140 can be easily removed for servicing and replaced.

A pair of springs 201 are disposed around the shaft 200 at either lateral side of the plate 141 and are provided with oppositely-biased arms which contact the plate 141 and a pressure adjustment plate 220, respectively, so that the plate 141 is biased clockwise with respect to the plate 220 in the orientation shown in FIGS. 1 and 5. The pressure adjustment plate 220 has a pair of longitudinal slots 222 which receive fasteners 224 to adjustably mount the plate 220 to the surface 214 of the bracket 130. The longitudinal position of the pressure adjustment plate 220 can be varied with respect to the slots 222 so that different tensions in springs 210 can be obtained and, in turn, allowing an accurate adjustment of the pressure of the print head 140 against the primary drive roller 121. Preferably, the cross-section of the pressure adjustment plate 220 is contoured to follow that of the surface 214 and associated wall 133 so that the pressure adjustment plate 220 is restricted to longitudinal motion with respect to the surface 214 to ensure a balance of the tension in the springs 201 and prevent misalignment of the print head 140. When the bracket 130 is mounted in the first position shown in FIG. 1, the print head 140 abuts the primary drive roller 121 and is biased thereagainst by the springs 201 at a pressure defined by the position of the pressure adjustment plate 220 with respect to the surface 214. The bias provided by the springs 201 provides for more reliable contact of the print head 140 against the primary drive roller 121 so that label material 112 passing therebetween is optimally printed by the print head 140.

Thus, when the printer 105 is moved to the first position shown in FIG. 1 whereby the pin 127 is engaged within the aperture 205, the idler roller 123 is biased against the secondary drive roller 122 by the spring 212 and the print head 140 is biased against the primary drive roller 121 by the springs 201.

The applicator 110 comprises a pneumatic cylinder 150 mounted within a housing 152 supported between a pair of opposed mounting plates 153 and 154. The applicator 110 is pivotally and releasably mounted to the housing 101 by a pair of vertically-spaced conventional quick-release hinges 111 so that the applicator is movable between a first operational position shown in FIG. 1 and a second service position as shown in the phantom outline of FIG. 3 whereby the entire applicator assembly 100 can be easily removed and replaced to prevent down time due to failure of the applicator 110. The applicator 110 is preferably retained in the first operational position shown in FIG. 1 by a pin 108 which extends between the applicator 110 and the housing 101. The pin 108 is preferably mounted to the housing 101 by a conventional manner, such as having a threaded end mounted within a tapped aperture (not shown) in the housing 101. Alternatively, the pin 108 can have a spring-loaded quick-release mechanism similar to that provided on the pin 127 or a conventional spring-loaded ball pin as is well known in the art. The pivotal and releasable mounting of the applicator 110 to the housing 101 by the hinges 111 allows the applicator to be easily accessed and replaced for cleaning, servicing and the like when pivoted to the second position and/or removed.

Figure 4:
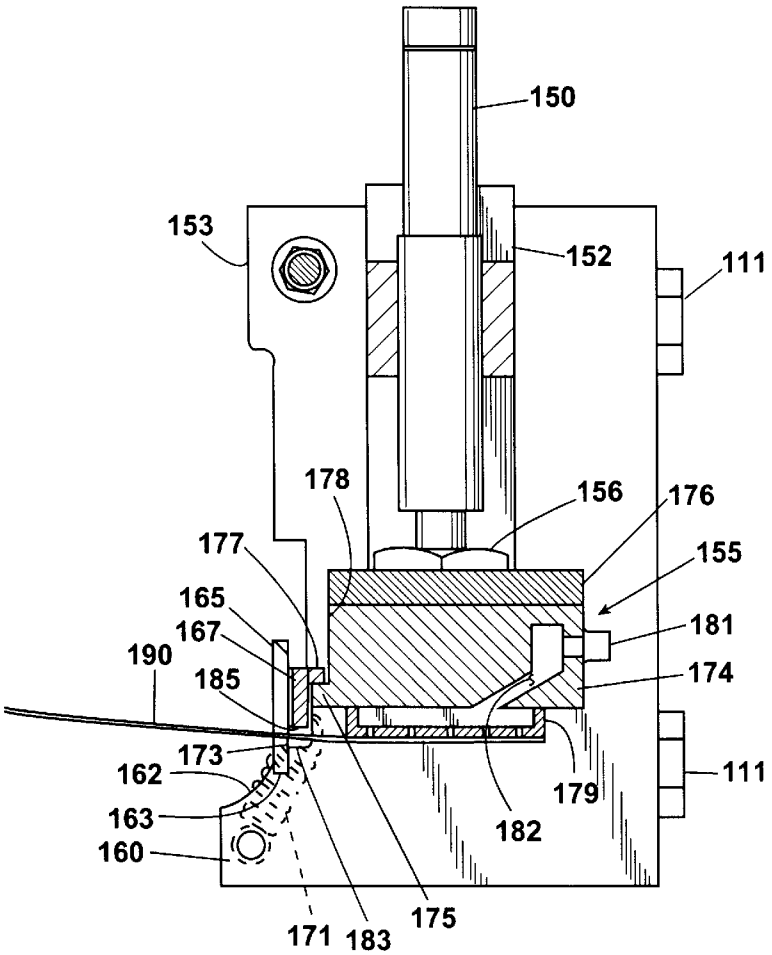
FIG. 4 is a cross-sectional view along line 4—4 of FIG. 3.
Figure 2:
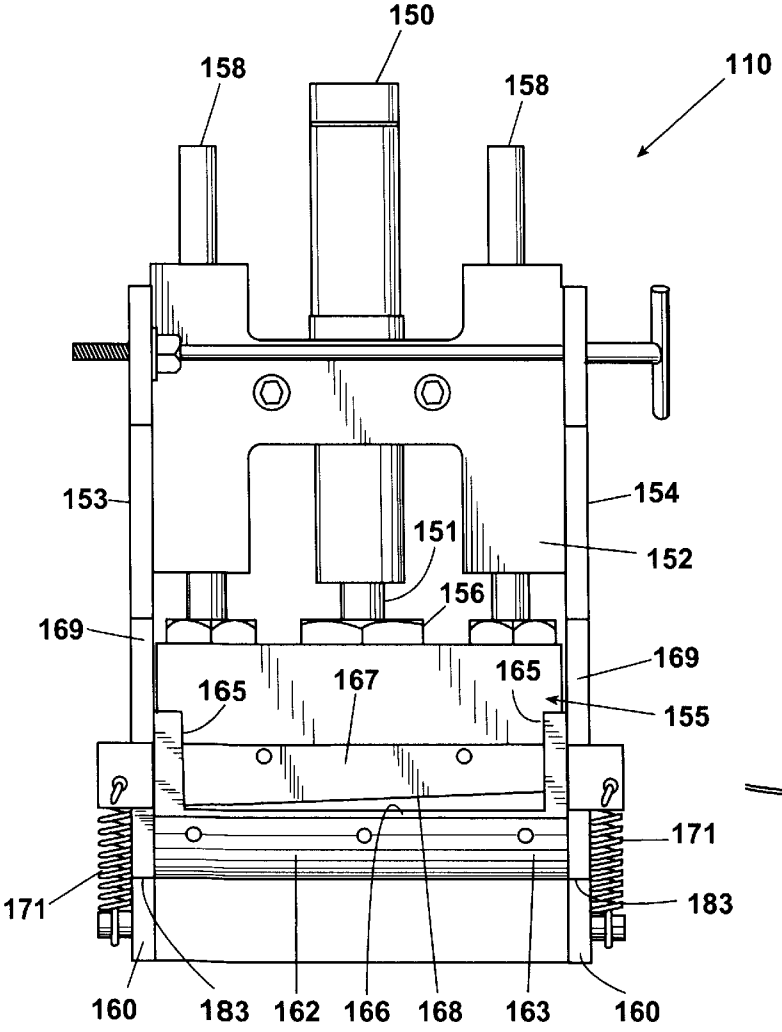
FIG. 2 is a cross-sectional view of the applicator mechanism along line 2—2 of FIG. 1 having an upper and a lower cutting knife thereon.

The cylinder 150 of the applicator 110 has an axially-extendable piston 151 which is attached to an applicator head 155 by a conventional mounting flange 156, such as the threaded nut shown in FIGS. 2 and 4. A pair of vertically-spaced guides 158 can be provided within the housing 152 in a spaced relationship so that the applicator head 155 is restricted to slidable vertical movement along the guides 158. Actuation of the cylinder 150 moves the piston 151 with respect thereto and, in turn, moves the applicator head 155 with respect to the housing 152.

Figure 9:
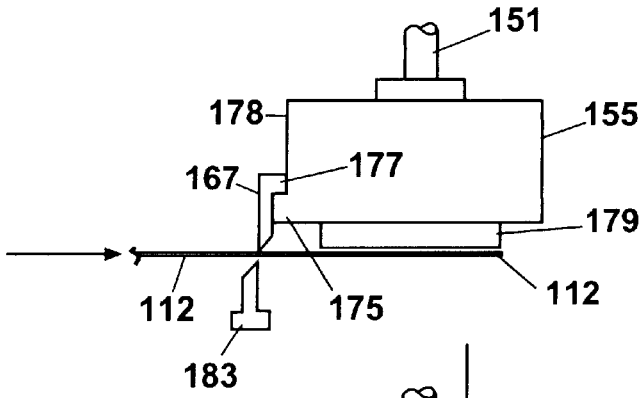
FIG. 9 is a schematic elevational view of the applicator of FIG. 4 shown in a retracted position above an object to be labeled in phantom outline.

Referring to FIGS. 2–4, the applicator head 155 generally comprises an upper plate 176, mounted to the piston 151 through the mounting flange 156, and a lower vacuum head 174 for movement between a retracted position shown in FIG. 4 to an extended position shown schematically in FIG. 9. The vacuum head 174 includes a port 181 for interconnection with a conventional vacuum source (not shown) and an internal conduit 182 which extends toward a lower surface of the vacuum 174 where it is interconnected with a vacuum plate 179 having several apertures therein. Suction applied to the port 181 by the vacuum source travels through the internal conduit 182 and is applied through the apertures in the vacuum plate 179. The vacuum head 174 and attachment plate 176 cooperate to define an indentation 178 in a lateral sidewall of the applicator head 155 which terminates in a lower laterally-extending flange 175.

Figure 7:
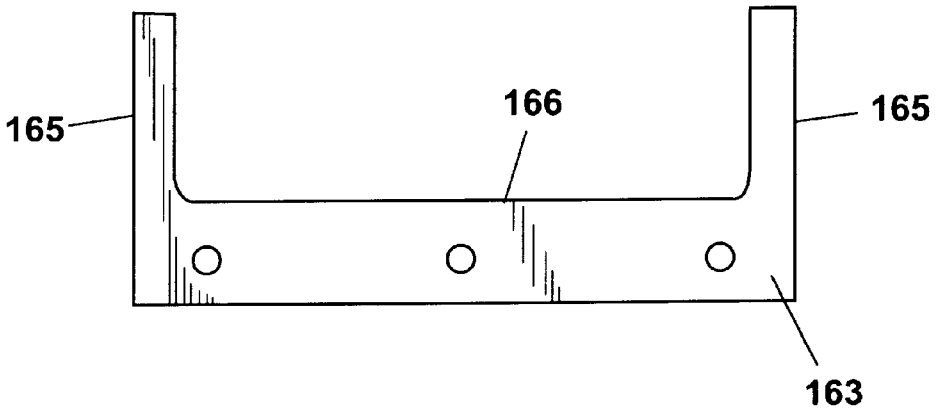
FIG. 7 is a front elevational view of the lower cutting knife depicted in FIG. 2.
Figure 8:
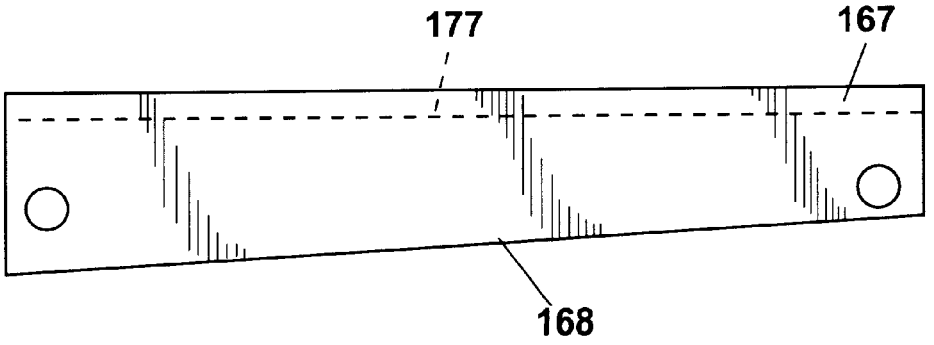
FIG. 8 is a front elevational view of the upper cutting knife depicted in FIG. 2.

A knife assembly, shown integral with the applicator 110 in FIGS. 2–4 and in components in FIGS. 7 and 8, comprises a fixed lower knife 163 and a movable upper knife 167. The lower knife 163 is shown in FIG. 7 and has an upper surface provided with a cutting edge 166 and opposing ends provided with vertically-extending guides 165 thereon. The lower knife 163 is mounted to the applicator 110 by conventional fasteners and is located upstream from the applicator head 155. The movable upper knife 167 is shown in FIG. 8 and has a cutting edge 168 on a lower surface thereof. A flange 177 extends rearwardly adjacent an upper edge of the upper knife 167 and is adapted to be slidably mounted against the indentation 178 located on the applicator head 155.

In assembly, the flange 177 on the upper knife 167 is placed within the indentation 178 on the applicator head 155 between the applicator head 155 and the guides 165. A pair of springs 171 are mounted to rearwardly-extending flanges 160 on each of the plates 153 and 154 of the applicator 110 which extend toward and mount within apertures 170 on the movable upper knife 167. Preferably, the springs are disposed at an angle with respect to the upper knife 167, such as between 0 and 90 degrees and preferably about 30 to 45 degrees with respect to the plane of the blades 163 and 167. The springs 171 bias the upper knife 167 against the lower knife 163 during the operation of the applicator 110 and specifically during the cutting of the label material 112 entering the applicator 110. The springs 171 also bias the upper knife 167 downwardly with respect to the applicator head 155 so that the upper knife 167 is biased against either the extending flange 175 or against the stops 183 on the plates 153 and 154 during application of a length of the label material 112.

In operation, a supply of label material 112 is advanced into the printer 105 over the rollers 115 and 118 and between the print head 140 and the primary drive roller 121 where the print head 140 is actuated through signals sent through the data connection 161 with a conventional printer driver to print indicia on the label material 112. If the label 112 is provided with a backing material 116, the backing material is passed around the peeler tip 139 of the bracket 131 and rearwardly between the idler roller 123 and the secondary drive roller 122 for accumulation on the take-up reel 125. As described above, the spring 212 biases the arm 210 and the idler roller 123 against the drive roller 122 to provide positive traction for urging the backing material 116 toward the take-up reel 125.

As shown in the drawings and schematically in FIG. 9, the printed label material 112, with any backing material 116 removed, is advanced between the lower knife 163 and the upper knife 167 while the applicator head 155 is positioned in a raised, retracted position by the cylinder 150. It will be understood that a conventional pneumatic source can be interconnected with the cylinder 150 for actuation thereof.

When a sufficient length of label material 112 is advanced beneath the applicator head 155, the cylinder 150 is actuated to extend the piston 151 therefrom which lowers the applicator head 155 toward a cutting position with respect to the label material 112 located therebeneath. The bias of the springs 171 urge the upper knife 167 downwardly so that the flange 177 on the upper knife 167 abuts the shoulder 175 beneath the indentation 178 on the applicator head 155 as the piston 151 moves downwardly from the retracted position. The vacuum source is applied to the port 181 so that the vacuum applied to the port 181 retains the label material 112 on the vacuum plate 179 through the vacuum applied through the apertures therein.

Figure 10:
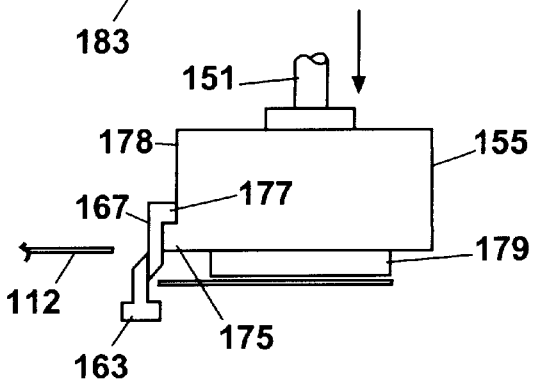
FIG. 10 is a schematic elevational view of the applicator of FIG. 4 shown in a cutting position whereby a discrete length of a continuous label material is severed from the remaining web.

As shown in the drawings and schematically in FIG. 10, the applicator head 155 is advanced downwardly by the cylinder and piston 150 and 151 so that the cutting edge 168 of the upper knife 167 passes directly adjacent to the cutting edge 166 of the lower knife 163. A length 164 of the label material 112 is severed from the remaining web.

Figure 11:
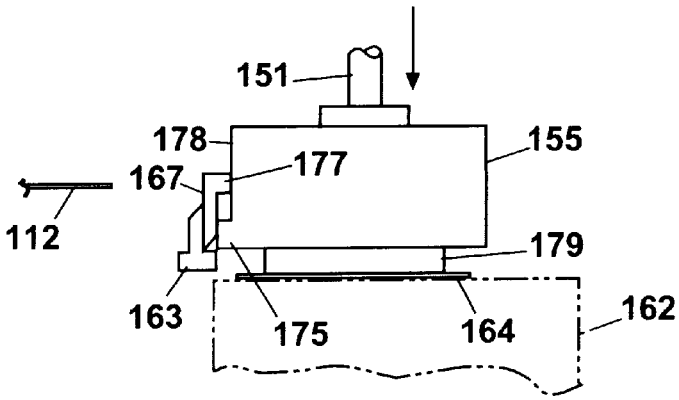
FIG. 11 is a schematic elevational view of the applicator of FIG. 4 shown in an extended position whereby an upper knife is retained against stops on the applicator and an applicator head moves past the stops to apply a label to the object.

As shown schematically in FIG. 11, the discrete length 164 of label material 112 is carried downwardly by the applicator head 155 and retained thereto by the vacuum source supplied to the port 181 through the vacuum plate 179. The applicator head 155 travels further toward an extended position.

The plates 153 and 154 have an inwardly-extending shoulder 183 located directly adjacent each lateral end of the upper knife 167. The shoulders 183 located on each plate 153 and 154 provide a lower stop for vertical motion of the upper knife 167 during downward movement of the applicator head 155 between the retracted and extended positions. The upper knife 167 is thereby prevented from traveling further with the applicator head 155 after the cutting position so that the cut label 164 is stripped from the upper knife 167 after the cutting operation when the upper knife 167 reaches the shoulders 183.

Thus, the applicator head 155 forcibly removes the cut label from the upper knife 167 when the applicator head 155 reaches the cutting position so that any adhesive buildup on the upper knife blade 167 does not affect the separation of the cut label 164 from the applicator head 155 or the upper knife blade 167. As the applicator head 155 continues to move from the cutting position to the extended position shown in FIGS. 10 and 11, respectively, the upper knife 167 slides with respect to the applicator head 155 by the mounting of the flange 177 of the upper knife 167 within the indentation 178 defined within the applicator head 155. Thus, the applicator head 155 is allowed to travel further downwardly while the upper knife 167 is stopped by the flanges 183.

During the extension of the piston 151 and, in turn, the applicator head 155, the springs 171 provide an angularly-directed force to the upper knife 167 so that the cutting edge 168 is urged toward the lower knife 163. The angular urging of the upper knife 167 against the lower knife 163 holds the upper knife 167 in close contact with the lower knife 163.

Figure 12:
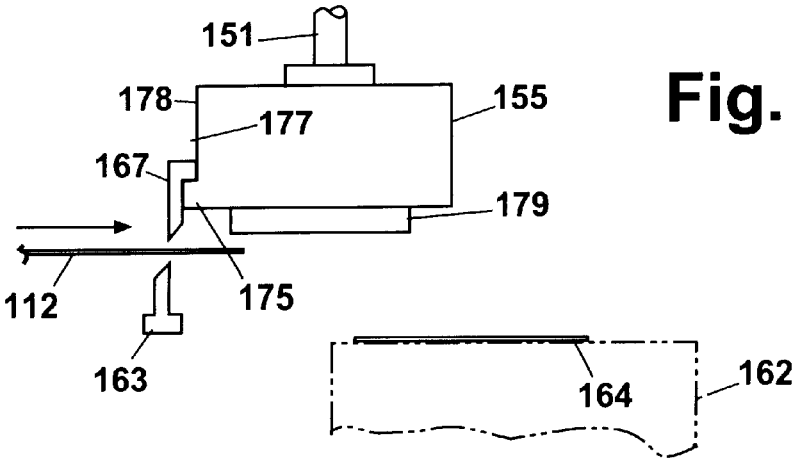
FIG. 12 is schematic elevational view of the applicator of FIG. 4 shown returned to a retracted position ready to receive a next discrete length of the continuous label material.

As the applicator head 155 reaches the extended position, it is urged downwardly and against an object 162, shown in phantom outline in FIGS. 9–12, on which the label material 112 is to be applied. The vacuum to the vacuum plate 179 is deactivated so that the label remains on the object. As shown in FIG. 12, the object 162 can be moved from beneath the applicator 110 and the piston 151 is retracted within the cylinder 150 so that the applicator head 155 is returned to a raised position to await cutting and applying a next length of label material 112 to the next object to be labeled.

As the applicator head 155 is returned to the retracted position as shown in FIG. 12, the shoulder 175 returns to engagement with the flange 177 on the upper knife 167 and raises the upper knife 167 to the retraced position against the bias of the springs 171 to the position illustrated in FIGS. 2, 4, 9 and 12.

The springs 171 urge the cutting edge 168 of the upper knife 167 against the lower knife 163 so that any misalignment of the upper knife 167 with respect to the lower knife 163 does not cause an undesirable cutting operation to be performed. Rather, the angular bias of the springs 171 with respect to the upper knife 167 causes the cutting edge 168 of the upper knife 167 to bear against the lower knife 163 so that the cutting edges 166 and 168 of the upper and lower knives 163 and 167 consistently pass directly adjacent one another.

The invention solves a problem of undesirable retention of a cut label on the upper knife 167 when the vacuum pressure to the applicator head is released. Although adhesive may continue to build up on the upper knife 167, it does not affect the labeling operation. Thus, the applicator 110 of the present invention provides longer operational times and reduces cost associated with labeling objects and servicing the apparatus 100.

Figure 13:
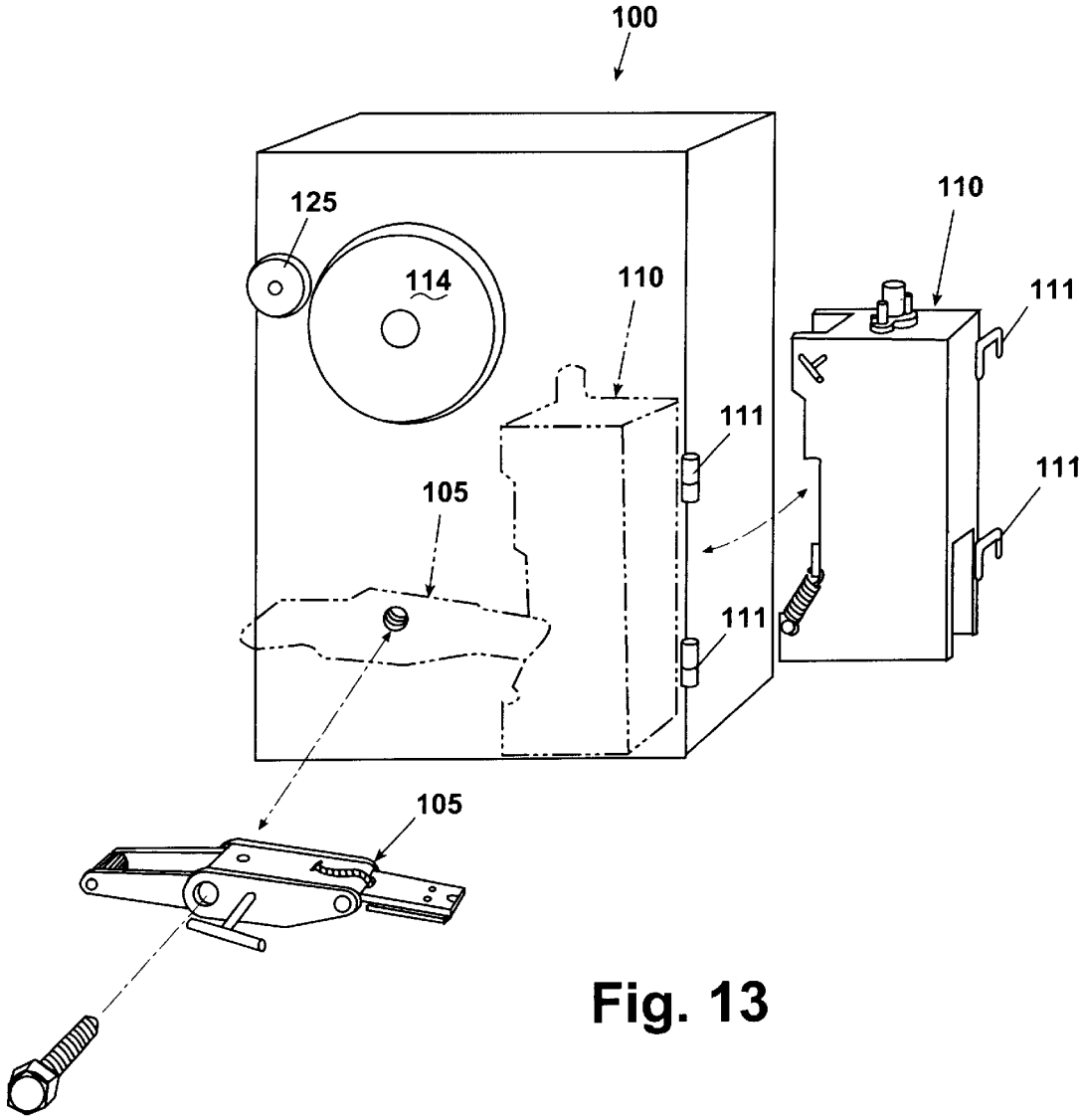
FIG. 13 is a schematic perspective view of the applicator of FIG. 4 showing the removable mounting of the printer and the applicator to the main housing.

The pivotal mounting of the printer 105 and applicator 110 enables an operator to easily access the print head 140 and knives 163 and 167 for servicing and cleaning. Further, as shown schematically in FIG. 13, each of the printer 105 and applicator 110 can be independently removed to prevent the deactivation of the apparatus 100 and its associated printing line for an extended period of time. It will be understood that the printer 105 can pivot beyond a small acute angle to a servicing position. Further, the printer 105 is able to pivot up to and beyond 90 degrees to allow easy access to its components.

In addition, the construction of the printer 105 and applicator 110 have been made with many fewer parts than in prior art label application machines. The printer 105 essentially comprises a printer bracket with a forward pivotal arm 141 which mounts the print head 140 and a rearward assembly which mounts an idler roller 123 thereon. Prior art label application machines typically required several threaded fasteners, welding operations, and many parts to form the printer 105 and applicator 110. In the apparatus 100 of the present invention, the number of parts required to assemble the apparatus 100 has been substantially reduced. The reduction of parts also reduces the probability of failure of one or more of the components of the apparatus 100. Thus, the apparatus 100 of the present invention offers substantial improvements in the effective operation time of the apparatus 100 as well as reduced time and cost associated with servicing the apparatus 100.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. An improved label application apparatus comprising:

a main housing;

a printer mounted to the housing;

an applicator mounted to the main housing adjacent to the printer for applying a label to an object;

a supply reel rotatably mounted to the main housing and having a continuous web of label material thereon;

a feed mechanism for feeding the continuous web of label material from the supply reel to the printer and applicator; and a cutting mechanism to cut labels from the continuous web of label material between the printer, and the applicator;

the improvement comprising:

the applicator is mounted to the main housing on hinges for movement between a first position aligned with the printer and a second position pivoted away from the first position for servicing;

the cutting mechanism has a first blade mounted on the applicator for movement therewith and relative movement with respect thereto and a second blade mounted to the main housing, wherein the first blade is operably aligned with the second blade when the applicator is in the first position and is separated from the second blade when the applicator is in the second position for servicing the cutting mechanism as well as the applicator; and a fastener for selectively retaining the applicator in the first position.

2. The label application apparatus of claim 1 wherein the printer is pivotally mounted to the housing for movement between a first position aligned with the applicator and a second position pivoted away from the first position for servicing; and a fastener for selectively retaining the printer in the first position.

3. The label application apparatus of claim 2 wherein the applicator comprises:

an applicator housing;

an applicator head; and the cutting mechanism comprising a first blade mounted to the applicator head for movement with the applicator head between a retracted and a cutting position and for relative movement between a cutting position and an extended position, the cutting position being intermediate the retracted and extended positions.

4. The label application apparatus of claim 3 wherein the printer comprises:

a roller mounted to the main housing;

a printer bracket;

a first arm pivotally mounted to the printer bracket and supporting a print head which is in registry with the roller; and a first spring biasing the first arm toward the roller.

5. The label application apparatus of claim 1 wherein the cutting mechanism comprises a first blade mounted to the applicator head for movement with the applicator head between a retracted and a cutting position and for relative movement between a cutting position and an extended position, the cutting position being intermediate the retracted and extended positions.

6. The label application apparatus of claim 1 wherein the printer comprises:

a roller mounted to the main housing;

a printer bracket;

a first arm pivotally mounted to the printer bracket and supporting a print head which is in registry with the roller; and a first spring biasing the first arm toward the roller.

7. An improved label application apparatus comprising:

a main housing;

a printer mounted to the housing;

an applicator mounted to the main housing adjacent to the printer for applying a label to an object;

a supply reel rotatable mounted to the main housing and having a continuous web of label material thereon;

a feed mechanism for feeding the continuous web of label material from the supply reel to the printer and applicator; and a cutting mechanism associated with the applicator to cut the labels from the continuous web of label material between the printer and the applicator;

the improvement comprising:

a shaft mounted to the main housing;

the printer is pivotally mounted to the main housing shaft for movement between a first position aligned with the applicator and a second position pivoted away from the first position for servicing, the printer having an opening in spaced relationship to the main housing shaft and having a sloped flange adjacent to the opening;

the main housing having an aperture therein aligned with the printer opening when the printer is in the first position; and a fastener mounted in the printer opening for axial and rotational movement with respect hereto and having an end adapted to be received in the main housing aperture when the printer is in the first position, the fastener having a cross pin engageable with the printer sloped flange, the cross pin is positioned against the printer sloped flange and, as the fastener cross pin is rotated against the printer sloped flange, the end of the fastener moves axially with respect to the main housing aperture to move the end of the fastener into and out of the main housing aperture whereby the fastener can be rotated to extend the fastener end into the main housing aperture to retain the printer in the first position.

8. The label application apparatus of claim 7 wherein the applicator comprises:

an applicator housing;

an applicator head; and the cutting mechanism comprising a first blade mounted to the applicator head for movement with the applicator head between a retracted and a cutting position and for relative movement between a cutting position and an extended position, the cutting position being intermediate the retracted and extended positions.

9. The label application apparatus of claim 8 wherein the printer comprises:

a roller mounted to the main housing;

a printer bracket;

a first arm pivotally mounted to the printer bracket and supporting a print head which is in registry with the roller; and a first spring biasing the first arm toward the roller.

10. The label application apparatus of claim 7 wherein the printer comprises:

a printer bracket;

a first arm pivotally mounted to the printer bracket and supporting a print head in register with a roller on the main housing; and a first spring biasing the first arm toward the roller.

11. An improved label application apparatus comprising:

a main housing;

a printer mounted to the main housing;

an applicator mounted to the main housing adjacent to the printer, the applicator comprising an applicator housing and an applicator head mounted to the applicator housing for movement between a retracted and an extended position for applying a label to an object;

a supply reel rotatably mounted to the housing and having a continuous web of label material thereon;

a feed mechanism for feeding the continuous web of label material from the supply reel to the printer and applicator; and a cutting mechanism associated with the applicator to cut the labels between the printer and the applicator;

the improvement comprising:

the cutting mechanism comprises:

a first blade movably mounted to the applicator head for movement with the applicator head between the retracted and a cutting position and for relative movement with respect to the applicator head between a cutting position and the extended position, the cutting position being intermediate the retracted and extended positions whereby the first blade moves with the applicator head between the retracted and cutting positions and moves with respect to the applicator head as the applicator head moves between the cutting and extended positions.

12. The label application apparatus of claim 11 and further comprising:

a second blade fixedly mounted closely adjacent to the first blade; and at least one spring mounted to the first blade and to one of the applicator and the main housing for biasing the first blade toward the second blade.

13. The label application apparatus of claim 12 wherein the first blade is slidably mounted to the applicator head for movement between the first and second positions.

14. The label application apparatus of claim 13 wherein the at least one spring further biases the first blade toward the cutting position.

15. The label application apparatus of claim 14 and further comprising a stop located between the first blade and the applicator head to limit the movement of the first blade with respect to the applicator head at the second position.

16. The label application apparatus of claim 15 and further comprising a second stop located between the first blade and one of the main housing and the applicator housing to limit the movement of the first blade with respect to the applicator head between movement of the applicator head between the cutting and extended positions.

17. The label application apparatus of claim 16 wherein the printer comprises:

a roller mounted to the main housing;

a printer bracket;

a first arm pivotally mounted to the printer bracket and supporting a print head which is in registry with the roller; and a first spring biasing the first arm toward the roller.

18. The label application apparatus of claim 11 wherein the first blade is slidably mounted to the applicator head for movement between the first and second positions.

19. The label application apparatus of claim 11 and further comprising a stop located between the first blade and the applicator head to limit the movement of the first blade with respect to the applicator head at the second position.

20. The label application apparatus of claim 19 and further comprising a second stop located between the first blade and one of the main housing and the applicator housing to limit the movement of the first blade with respect to the applicator head between movement of the applicator head between the cutting and extended positions.

21. The label application apparatus of claim 11 wherein the printer comprises:

a printer bracket;

a first arm pivotally mounted to the printer bracket and supporting a print head; and a first spring biasing the first arm toward a roller mounted to the main housing.

22. An improved label application apparatus comprising:

a main housing having a roller;

a printer mounted to the main housing adjacent to the roller;

an applicator mounted to the main housing adjacent to the printer for applying a label to an object;

a supply reel rotatably mounted to the main housing and having a continuous web of label material thereon;

a feed mechanism for feeding the continuous web of label material from the supply reel to the printer and applicator;

a cutting mechanism associated with the applicator to cut the labels between the printer and the applicator;

the improvement comprising:

the printer comprises:

a roller mounted to the main housing;

a printer bracket mounted to the main housing;

a first arm pivotally mounted to the printer bracket and supporting a print head which is in registry with the roller; and a first spring biasing the first arm toward the roller.

23. The label application apparatus of claim 22 and further comprising:

a take-up reel rotatably mounted to the housing for accumulation of at least a portion of the continuous web of label material; and a drive roller for driving the at least a portion of the continuous web of label material toward the take-up reel.

24. The label application apparatus of claim 23 and further comprising a second arm pivotally mounted to the printer bracket with an idler roller rotatably mounted to an outer end thereof, the idler roller is in register with the drive roller, a second spring mounted between the second arm and the printer bracket to bias the idler roller against the drive roller.

25. An improved label application apparatus comprising:

a main housing;

a printer mounted to the main housing;

an applicator mounted to the main housing adjacent to the printer for applying a label to an object;

a supply reel rotatably mounted to the main housing and having a continuous web of label material thereon;

a feed mechanism for feeding the continuous web of label material from the supply reel to the printer and applicator; and a cutting mechanism associated with the applicator to cut labels from the continuous web of label material between the printer and the applicator;

the improvement comprising:

an applicator support on the main housing and adapted to support the applicator;

a main housing connector on the applicator and adapted to be received by the applicator support to selectively support the applicator and thereby restrict movement of the applicator in a downwardly direction but not in another direction with respect to the main housing;

whereby the applicator is selectively removably mounted to the main housing for applying a label to an article when mounted to the main housing and is selectively removable from the main housing by moving the applicator in the other direction for replacement or servicing.

26. The label apparatus of claim 25 wherein the applicator support and main housing connector comprise quick-release hinges to pivotally mount the applicator to the main housing and the another direction is upwardly with respect to the main housing.

27. The label apparatus of claim 26 and further comprising a fastener removably mounted between the applicator and the main housing for restricting pivotal movement of the applicator with respect to the main housing.

28. The label apparatus of claim 25 and further comprising a fastener removably mounted between the applicator and the main housing for restricting movement of the applicator with respect to the main housing in the another direction.

29. An improved label application apparatus comprising:

a main housing;

a printer mounted to the main housing;

an applicator mounted to the main housing adjacent to the printer for applying a label to an object;

a supply reel rotatably mounted to the main housing and having a continuous web of label material thereon;

a feed mechanism for feeding the continuous web of label material from the supply reel to the printer and applicator; and a cutting mechanism associated with the applicator to cut labels from the continuous web of label material between the printer and the applicator;

the improvement comprising:

a quick-release mechanism disposed between the printer and the housing wherein the quick-release mechanism is movable with respect to the printer and the housing between a first position and a second position, wherein the printer is mounted to the housing by the quick-release mechanism in the first position and the printer can be removed from the housing in the second position, and wherein the quick-release mechanism is movable between the first and second positions without the use of tools.

30. The label apparatus of claim 29 wherein the mounting of the fastener within the socket also pivotally mounts the printer to the main housing.

31. The label application apparatus of claim 29 wherein the quick-release mechanism comprises a keyed fastener, the printer comprises a bore, the housing further comprises a keyed socket, and wherein when the keyed fastener is inserted through the bore and into the socket in the second position and rotated to the first position, wherein the keyed socket prevents axial removal of the fastener in the first position.

32. An improved label application apparatus comprising:

a main housing including a print roller;

a printer mounted to the main housing, the printer comprising a printer bracket mounted to the main housing and a print head pivotally mounted to the printer bracket and in register with the print roller, at least one spring between the printer bracket and the print head biasing the print head against the print roller;

an applicator mounted to the main housing adjacent to the printer for applying a label to an object;

a supply reel rotatably mounted to the main housing and having a continuous web of label material thereon;

a feed mechanism for feeding the continuous web of label material from the supply reel to the printer and applicator; and a cutting mechanism associated with the applicator to cut labels from the continuous web of label material between the printer and the applicator;

the improvement comprising:

the printer further comprises an adjustment plate abutting the at least one spring and mounted to the printer bracket for slidable movement toward and away from the spring to adjust the tension in the spring and thereby adjust the force of the print head against the print roller.

33. The label apparatus of claim 32 wherein:

the adjustment plate has opposing lateral edges;

the at least one spring comprises a spring disposed between each lateral edge of the adjustment plate and the print head.

34. The label apparatus of claim 33 wherein:

the adjustment plate has at least one elongated slot; and at least one fastener;

wherein the at least one fastener is selectively mounted to the printer bracket within the at least one elongated slot to selectively mount the adjustment plate at a particular longitudinal position with respect to the printer bracket.

35. The label application apparatus of claim 32 wherein the adjustment plate has at least one slot elongated in an axial direction, the printer bracket has at least one fastener received in the at least one slot and mounting the adjustment plate to the printer bracket in the axial direction.

36. The label application apparatus of claim 32 wherein the at least one spring comprises a torsion spring.

37. An improved label application apparatus comprising:

a main housing;

a printer mounted to the main housing;

an applicator mounted to the main housing adjacent to the printer, the applicator comprising an applicator housing and an applicator head mounted to the applicator housing for movement between a retracted and an extended position for applying a label to an object;

a supply reel rotatably mounted to the housing and having a continuous web of label material thereon;

a feed mechanism for feeding the continuous web of label material from the supply reel to the printer and applicator; and a cutting mechanism associated with the applicator to cut the labels between the printer and the applicator;

the improvement comprising:

the cutting mechanism comprises:

a first blade mounted to the applicator head for movement with the applicator head when the applicator moves between the retracted and a cutting position and for relative movement with respect to the applicator head when the applicator moves between the cutting position and the extended position, the cutting position being intermediate the retracted and extended positions;

a second blade fixedly mounted to the main housing closely adjacent to the first blade; and at least one spring mounted to the first blade and to one of the applicator and the main housing for biasing the first blade toward the second blade.

38. The label application apparatus of claim 37 wherein the first blade is slidably mounted to the applicator head for movement with respect to the applicator head when the applicator moves between the between the cutting and extended positions.

39. The label application apparatus of claim 38 wherein the at least one spring further biases the first blade toward the cutting position.

40. The label application apparatus of claim 39 and further comprising a stop located between the first blade and the applicator head to limit the movement of the first blade with respect to the applicator head at the second position.

41. The label application apparatus of claim 40 and further comprising a second stop located between the first blade and one of the main housing and the applicator housing to limit the movement of the first blade with respect to the applicator head between movement of the applicator head between the cutting and extended positions.

42. The label application apparatus of claim 41 wherein the printer comprises:

a roller mounted to the main housing;

a printer bracket;

a first arm pivotally mounted to the printer bracket and supporting a print head which is in registry with the roller; and a first spring biasing the first arm toward the roller.

* * * * *

UNITED STATES PATENT AND TRADEMARK OFFICE

CERTIFICATE OF CORRECTION

PATENT NO. : 6,182,730 B1
DATED : February 6, 2001
INVENTOR(S) : David F. Muir

It is certified that error appears in the above-identified patent and that said Letters Patent is hereby corrected as shown below:

Claim 7, column 1,
Line 6, "rotatable" should read -- rotatably --.

Claim 25, column 2,
Line 13, "other" should read -- another --.

Claim 38, column 2,
Line 26, please delete "the between".

Signed and Sealed this

Second Day of October, 2001

*Attest:*

Nicholas P. Godici

*Attesting Officer*

NICHOLAS P. GODICI
*Acting Director of the United States Patent and Trademark Office*